US009677381B2

(12) United States Patent
Reid

(10) Patent No.: US 9,677,381 B2
(45) Date of Patent: Jun. 13, 2017

(54) DOWNHOLE HYDRAULIC CONTROL LINE

(71) Applicant: Halliburton Manufacturing & Services Limited, Leatherhead (GB)

(72) Inventor: Michael A. Reid, Aberdeen (GB)

(73) Assignee: Halliburton Manufacturing & Services Limited, Leatherhead (GB)

( * ) Notice: Subject to any disclaimer, the term of this patent is extended or adjusted under 35 U.S.C. 154(b) by 646 days.

(21) Appl. No.: 14/089,569

(22) Filed: Nov. 25, 2013

(65) Prior Publication Data

US 2014/0151066 A1 Jun. 5, 2014

Related U.S. Application Data

(62) Division of application No. 12/800,435, filed on May 14, 2010, now Pat. No. 8,602,107.

(30) Foreign Application Priority Data

May 15, 2009 (GB) ..... 0908415.3

(51) Int. Cl.

| | |
|---|---|
| ***E21B 41/00*** | (2006.01) |
| ***E21B 23/04*** | (2006.01) |
| ***E21B 34/10*** | (2006.01) |
| ***E21B 34/06*** | (2006.01) |

(52) U.S. Cl.

CPC ..... *E21B 41/00* (2013.01); *E21B 23/04* (2013.01); *E21B 34/066* (2013.01); *E21B 34/10* (2013.01); *Y10T 137/86638* (2015.04)

(58) Field of Classification Search

CPC ..... E21B 17/023; E21B 34/10

See application file for complete search history.

(56) References Cited

U.S. PATENT DOCUMENTS

| | | | | |
|---|---|---|---|---|
| 4,660,647 | A * | 4/1987 | Richart | E21B 34/107 166/115 |
| 5,273,072 | A | 12/1993 | Phillips | |
| 5,392,858 | A | 2/1995 | Peters et al. | |
| 6,070,608 | A * | 6/2000 | Pringle | E21B 34/066 137/155 |

(Continued)

FOREIGN PATENT DOCUMENTS

| | | |
|---|---|---|
| GB | 1008013 | 6/2010 |

OTHER PUBLICATIONS

Authorized Officer Dr. Lyndon Ellis, Combined Search and Examination Report under Sections 17 and 18(3) in UK Application No. GB1302131.6, mailed Mar. 19, 2013, 38 pages.

*Primary Examiner* — Robert E Fuller

(74) *Attorney, Agent, or Firm* — Benjamin Fite; Parker Justiss, P.C.

(57) ABSTRACT

A downhole hydraulic control tool comprising a substantially tubular body adapted for connection in a tubing string, the body including a throughbore arranged coaxially with a bore of the tubing string and one or more pockets arranged on a wall of the body, the pockets including a hydraulic power source and at least two control lines, wherein the device includes a pump to drive hydraulic fluid through the control lines and a switchable flow mechanism for switching the flow of pumped fluid between the at least two control lines, and a switchable flow mechanism and a method of operating one or more downhole devices from a downhole located hydraulic control tool.

22 Claims, 8 Drawing Sheets

(56) References Cited

U.S. PATENT DOCUMENTS

| | | | | |
|---|---|---|---|---|
| 6,321,842 | B1 | 11/2001 | Pringle et al. | |
| 6,502,640 | B2 * | 1/2003 | Rayssiguier | E21B 23/006 166/321 |
| 7,013,917 | B2 | 3/2006 | Joseph, III | |
| 7,108,073 | B2 | 9/2006 | Patel | |
| 7,195,225 | B1 | 3/2007 | Holliday | |
| 7,337,850 | B2 | 3/2008 | Contant | |
| 7,635,029 | B2 | 12/2009 | MacDougall et al. | |
| 2002/0066574 | A1 | 6/2002 | Leismer et al. | |
| 2008/0080991 | A1 * | 4/2008 | Yuratich | F04B 9/02 417/390 |
| 2010/0212882 | A1 * | 8/2010 | Guven | E21B 23/04 166/65.1 |

* cited by examiner

DOWNHOLE HYDRAULIC CONTROL LINE

This application is a Divisional of and claims the benefit of priority to U.S. patent application Ser. No. 12/800,435, filed on May 14, 2010 and entitled "Downhole Hydraulic Control Line", which claims the benefit of priority to GB Application Serial Number 0908415.3, filed on May 15, 2009, the contents of which are hereby incorporated by reference.

BACKGROUND OF THE INVENTION

1. Field of the Invention

The present invention relates to well completion equipment, and more specifically to a mechanism for remotely actuating a downhole well tool that requires pressurized hydraulic fluid to operate.

2. Description of Related Art

Well completion equipment is used in a variety of well related applications involving, for example, the production of fluids. The completion equipment is deployed in a wellbore and requires power to operate, or shift from position to position in accordance with each device's intended purpose. The actuation of these downhole devices is typically accomplished by running a hydraulic control line or lines from the well surface, through the well to the device and then, by applying pressure through the line, the device can be made to operate.

There are a number of disadvantages with such an arrangement. The most obvious is the difficulty in installing a control line through a deep or extended well. As the control line may be required to pass through different zones in the well, it must be adapted to pass through or around all the devices which are present in the well bore. As some of these devices may be packers used to seal sections of the well tubing, it is difficult to make a connection through a packer and maintain the sealing integrity required of the packer. Additionally, as these lines are kept as small as possible so as to be unobtrusive, they have narrow diameters, which results in slow response times if the device is located deep in the well. Yet further there are typically a number of devices located in the completion tubing. As a result multiple hydraulic control lines must be run from the surface through the well. This adds to the complexity of running a completion string.

In an attempt to over come some of these difficulties, hydraulic actuators have been developed which enable multiple devices to be operated from a single hydraulic control line. A single hydraulic power source is located at surface and a main control line is run into the wellbore to the actuator. As the hydraulic power source is still located at the surface, the response times can be slow. Additionally, in order to use a single control line, the devices typically operate in a defined sequence, the order being determined from the actuator arrangement. This limits the speed of response further as each device in the sequence must be operated before the desired device can be made to operate. Additionally as all the devices are working from a single control line, any failure of the control line and/or the actuator can render all the devices inoperable. The speed of response can be increased by using multiplexers and enhancers. These unfortunately add to the space required for the actuator in the well bore and increase the complexity of the arrangement making it difficult to install and prone to failure.

SUMMARY OF THE INVENTION

It is therefore an object of the present invention to provide a downhole hydraulic control tool having a hydraulic power source with a control line, locatable in the completion string. In this way, there is no requirement to have control lines passing through the length of the well, the control line will only be required to span the distance between the power source and the downhole device.

It is a yet further object of at least one embodiment of the present invention to provide a switchable flow mechanism with switchable flow paths for a closed loop control system.

According to a first aspect of the present invention there is provided a downhole hydraulic control tool comprising a substantially tubular body adapted for connection in a tubing string, the body including a throughbore arranged coaxially with a bore of the tubing string and one or more pockets arranged on a wall of the body, the pockets including a hydraulic power source and at least two control lines, wherein the device includes a pump to drive hydraulic fluid through the control lines and a switchable flow mechanism for switching the flow of pumped fluid between the at least two control lines.

In this way, the control for a downhole device can be located in the wellbore adjacent to the tool and a control line does not need to be run from the surface of the well.

Preferably, the tool includes an electronic module, the electronic module controlling the operation of the pump and the switchable flow mechanism. The electronic module is preferably programmable so that the tool can be preprogrammed to behave in response to a trigger signal when downhole.

It is preferred that the trigger signal for the hydraulic control tool is created by varying wellbore fluid pressure in the tubing by applying a predetermined pressure for a predetermined time. In this way, if the pressure and/or time conditions are outside the predetermined pressure/time window for the hydraulic control tool, the hydraulic control tool will not be activated.

Thus, the trigger signal is advantageously created in response to an applied and maintained pressure within a predetermined pressure range (or "activation window") for a certain period of time. If this condition is not satisfied, the trigger signal is not created. This enables a range of different pressure tests to be performed in the wellbore, for example at pressures outside of the predetermined range and/or at pressures within the activation window but over a time period shorter than that required for activation of the tool.

The tool operates on the principle that pressure testing events do not occur for long durations at pressures within the predetermined pressure zone. Conversely, a pressure event for creating the trigger signal must be identified as being in the predetermined zone for a sufficient period of time within a defined pressure zone.

If the pressure event is classified as an activation window, i.e. the applied pressure falls within the predetermined pressure window for the hydraulic control tool, the tool monitors the applied pressure to see if the pressure remains in the predetermined pressure window for the specified predetermined time. If the pressure remains in the predetermined pressure window for the specified predetermined time, the trigger signal will be created.

Thus, operation of the hydraulic control tool is controlled by a pressure/time discriminator mechanism. By way of this mechanism, a trigger signal will be created and the hydraulic control tool will be operated only when the predetermined pressure/time window is met, that is to say, the command to operate is applied.

It will be understood that any suitable predetermined pressure may be selected. It will also be understood that the predetermined pressure will be selectable in advance of deployment of the hydraulic control tool and may be selected on the basis of the downhole conditions.

In embodiments of the invention, a plurality of hydraulic control tools may each be preprogrammed to respond to a specified trigger signal. More specifically, each one of the plurality of hydraulic control tools may be preprogrammed to respond to a different trigger signal. In this way, multiple trigger signals may be created to actuate any number of hydraulic control tools.

The predetermined time period may be in the range 5 to 10 mins. It will be understood that any suitable predetermined time may be selected, however, it is preferred that the predetermined time is greater than 5 minutes in order to differentiate the command signal from fluctuations in downhole conditions and/or pressure tests performed on the device.

Optionally the electronics module includes a stored power supply such as a battery though other power means may be considered.

Preferably, the tool includes a first motor and gear assembly to operate the pump. Preferably the tool includes a second motor and gear assembly to operate the switchable flow mechanism. Preferably the switchable flow mechanism is located between the first and second motors. In this way the hydraulic fluid can flood a portion of the unit around the motors and reduce the amount of seals required.

Preferably the tool includes a pressure sensor acted on by the hydraulic fluid. Advantageously the unit includes a chamber in which hydraulic fluid is located and the pressure sensor measures hydraulic fluid pressure in the chamber. More preferably there is a piston at an end of the chamber arranged so that tubing pressure can act upon a side of the piston thereby reducing the volume of the chamber. In this way the pressure sensor can be responsive to tubing pressure without being directly exposed to the fluid in the tubing.

Advantageously the pressure sensor is connected to the electronics module to provide the triggering signal. In this way, the tool can be controlled from the surface of the well without requiring a dedicated hydraulic control line.

Preferably there are two control lines and the pumped fluid is switched between the control lines. In this way a device is positively switched between states such as 'on' and 'off'. Such an arrangement also provides for a closed loop hydraulic control unit.

According to a second aspect of the present invention there is provided a switchable flow mechanism for use in a downhole fluid control tool, the mechanism comprising an element arranged to rotate within the tool, the element including a plurality of switchable flow ports on a surface thereof, wherein flow paths are arranged through the element between pairs of switchable flow ports and each flow path is arranged off axis through the element.

By arranging the flow paths so that they do not pass through the central axis of the element a plurality of distinct flow paths can be arranged through the element. Rotation of the element allows a change in position of the switchable flow ports and consequently a change in the direction of fluid flow through the element.

Preferably there are a plurality of housing flow ports arranged around the element, such that each housing flow port aligns with a switchable flow port. The housing flow ports may include connections to control lines of the tool.

In certain embodiments of the second aspect, the ports are arranged such that each flow path is never blocked or sealed when the element is in each rotated location. This prevents any build-up of fluid pressure through the element.

In alternative embodiments, the element may be rotated to a position wherein each housing flow port is mis-aligned with a switchable flow port. This is to say, each housing port is out of alignment with a switchable flow port. In this "mid-position" of the element, fluid flow to the housing ports is provided by a recess in the surface of the element. Such fluid flow maintains the element, and the tool, in the balanced position. This neutral position in which the switchable flow mechanism is in neither the "on" nor the "off" position, is advantageous during run-in of the tool. During run-in, the tool may heat up and the fluid in the control lines expands. In the neutral position, pressure on either side of the actuation piston is maintained as being equal, therefore, ensuring the switchable flow mechanism does not operate unless and until desired.

In certain embodiments, it is preferred that at least a portion of the element is rounded and the flow paths are arranged within the rounded section. Such rounding allows the element to be rotated in a fashion similar to a ball valve. Preferably the element includes a spindle for connection to a motor of a drive assembly. The spindle is preferably arranged on axis, so that the element can be rotated in response to rotation of the spindle. Preferably the flow paths are arranged such that a 90 degree rotation of the element is sufficient to switch the flow paths between housing flow ports. Preferably the housing flow ports and the switchable flow ports are arranged substantially perpendicularly to the axis of rotation of the element.

In alternative embodiments, at least a portion of the element is formed of a cylindrical section with flow paths arranged within the cylindrical section. The end face of the cylinder is the sealing surface with the flow ports arranged at 180 degrees about the central axis i.e. opposing one another. The flow ports of the housing are aligned in face-to-face relation with the switchable flow ports. Preferably the element includes a spindle for connection to a motor of a drive assembly. The spindle is preferably arranged on axis, so that the element can be rotated in response to rotation of the spindle. Preferably the flow paths are arranged such that a 180 degree rotation of the cylindrical element is sufficient to switch the flow paths between housing flow ports. Preferably the housing flow ports and the switchable flow ports are arranged substantially parallel to the axis of rotation of the cylindrical element.

In embodiments of the second aspect, a plurality of distinct flow paths are arranged through the cylindrical element. In these embodiments of the second aspect, the cylindrical element comprises a partial central bore passing through the central axis thereof; the partial central bore of the cylindrical element is in fluid communication with the flow paths of the cylindrical element. Thus, the partial central bore does not form a throughbore passing completely through the cylindrical element. Rotation of the cylindrical element allows a change in position of the switchable flow ports and consequently a change in the direction of fluid flow through the element.

In embodiments comprising a cylindrical element, it is preferred that there are a plurality of housing flow ports arranged in the element. The housing flow ports may include connections to control lines of the tool.

Preferably the switchable flow mechanism is located in a pocket of a downhole hydraulic control tool according to the first aspect. More specifically, in preferred embodiments, the switchable flow mechanism is attached to the wall of the body and covered with a cover plate.

According to a third aspect of the present invention there is provided a method of operating one or more downhole devices from a downhole located hydraulic control tool, the method comprising the steps of:

(a) locating a hydraulic control tool according to the first aspect in a tubing string;

(b) locating at least one downhole device adjacent to the hydraulic control tool and connecting control lines of the hydraulic control tool to control lines of the at least one downhole device;

(c) running the tubing string into a well bore;

(d) varying wellbore fluid pressure in the tubing to create a trigger signal for the hydraulic control tool; and (e) operating the at least one downhole device by pumping hydraulic fluid through at least one of the control lines between the hydraulic control tool and the downhole device.

In this way, the hydraulic control tool is run-in with the downhole device. As the tool has a throughbore it does not interfere with the movement of fluids through the tubing. Thus the method may include the step of passing fluid through the throughbore. Such may be the case of production fluids travelling up a completion string.

Additionally as the downhole device is operated by varying the well fluid pressure in the tubing, rather than varying pressure in hydraulic fluid in a control line from the surface of the well, there is no requirement to have control line(s) run from the surface of the well.

It is preferred that the trigger signal for the hydraulic control tool is created by varying wellbore fluid pressure in the tubing by applying a predetermined pressure for a predetermined time. In this way, if the pressure and/or time conditions are outside the predetermined pressure/time window for the hydraulic control tool, the hydraulic control tool will not be activated.

Thus, the trigger signal is, advantageously created in response to an applied and maintained pressure within a predetermined pressure range (or "activation window") for a certain period of time. If this condition is not satisfied, the trigger signal is not created. This enables a range of different pressure tests to be performed in the wellbore, for example at pressures outside of the predetermined range and/or at pressures within the activation window but over a time period shorter than that required for activation of the tool.

The tool operates on the principle that pressure testing events do not occur for long durations at pressures within the predetermined pressure zone. Conversely, a pressure event for creating the trigger signal must be identified as being in the predetermined zone for a sufficient period of time within a defined pressure zone.

If the pressure event is classified as an activation window, i.e. the applied pressure falls within the predetermined pressure window for the hydraulic control tool, the tool monitors the applied pressure to see if the pressure remains in the predetermined pressure window for the specified predetermined time. If the pressure remains in the predetermined pressure window for the specified predetermined time, the trigger signal will be created.

Thus, operation of the hydraulic control tool is controlled by a pressure/time discriminator mechanism. By way of this mechanism, a trigger signal will be created and the hydraulic control tool will be operated only when the predetermined pressure/time window is met, that is to say, the command to operate is applied.

It will be understood that any suitable predetermined pressure may be selected. It will also be understood that the predetermined pressure will be selectable in advance of deployment of the hydraulic control tool and may be selected on the basis of the downhole conditions.

In embodiments of the invention, a plurality of hydraulic control tools may each be preprogrammed to respond to a specified trigger signal. More specifically, each one of the plurality of hydraulic control tools may be preprogrammed to respond to a different trigger signal. In this way, multiple trigger signals may be created to actuate any number of hydraulic control tools.

The predetermined time period may be in the range 5 to 10 mins. It will be understood that any suitable predetermined time may be selected, however, it is preferred that the predetermined time is greater than 5 minutes in order to differentiate the command signal from fluctuations in downhole conditions and/or pressure tests performed on the device.

Preferably the method includes the step of operating a fluid switchable flow mechanism in the hydraulic control tool to switch the pumped fluid to a second control line. Preferably, a second function of the downhole device is operated from the second control line. Alternatively a further downhole device may be actuated from the second control line.

It will be understood that features described in respect of the first, second or third aspects of the present invention may be present in one or more of the other aspects of the invention.

BRIEF DESCRIPTION OF THE DRAWINGS

Embodiments of the present invention will now be described, for example only, with reference to the following drawings of which.

DETAILED DESCRIPTION OF PREFERRED EMBODIMENTS

Figure 1A:
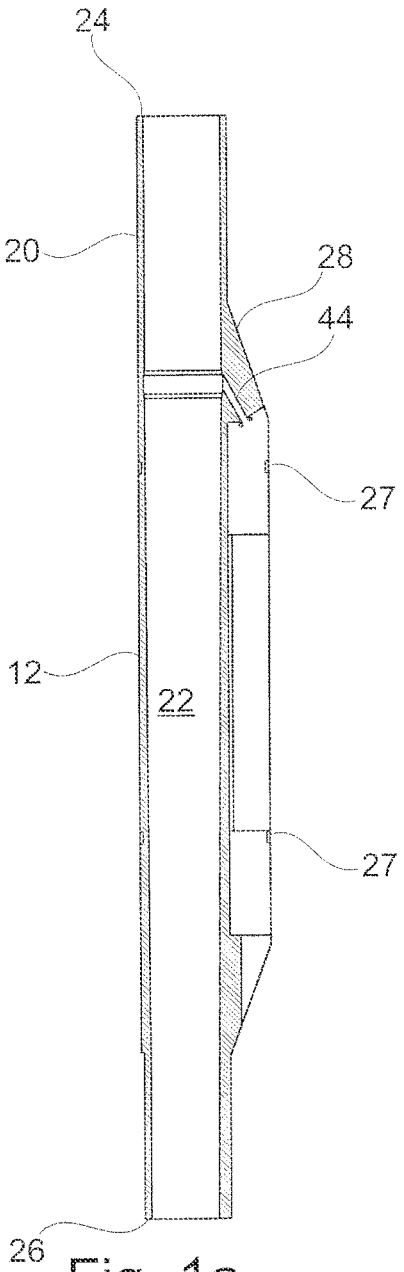
FIGS. 1(*a*)-(*d*) is a schematic illustration of an embodiment of a body of a downhole hydraulic control tool and of the tool (FIG. 1(*d*)), according to the present invention.
Figure 1B:
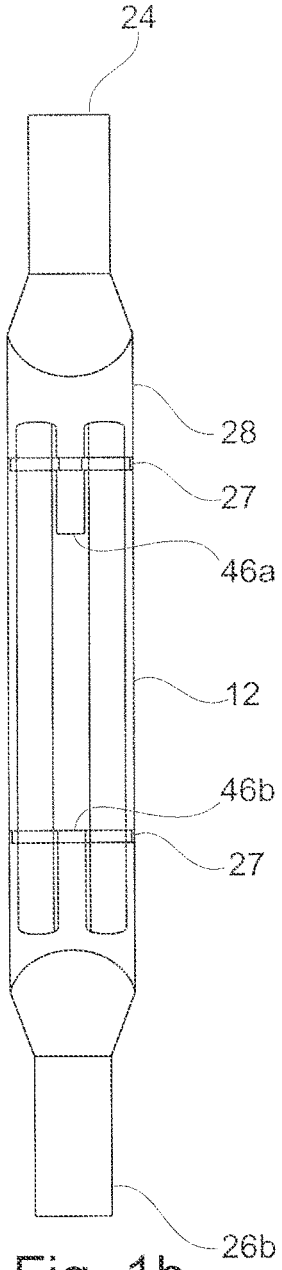
Figure 1C:
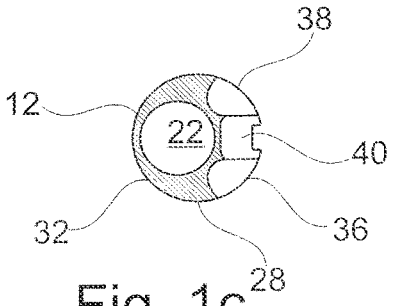
Figure 1D:
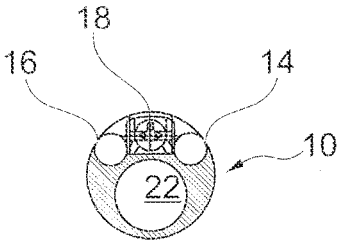

Reference is initially made to FIG. 1(*d*) of the drawings which illustrates a downhole hydraulic control tool, generally indicated by reference numeral 10, according to an embodiment of the present invention. FIGS. 1(*a*)-(*c*) illustrate the body 12 into which modules 14, 16, 18 are located. Body 12 comprises a mandrel 20 having a bore 22 therethrough. The upper 24 and lower 26 ends of the body will have suitable connectors as are known in the art to connect the body into a tubing string (not shown). When connected in the string, the bore 22 is coaxial with the bore of the tubing string.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

The body 12 is substantially cylindrical with the bore 22 located off-axis from the centre 30 of the cylinder 32. This arrangement provides a saddle portion 28 to one side of the bore 22. It is noted that the saddle 28 does not extend the full length of the body 12. Accordingly, the ends 24, 26 of the body are also cylindrical, but have a central axis 34 which is co-linear with the centre of the bore 22.

The saddle portion 28 contains three pockets, troughs or channels 36, 38, 40 located adjacent to each other around the cylinder 32. Each channel 36, 38, 40 is adapted to receive a module 14, 16, 18 Connection through to the bore 22 is present as a port 44 is milled through the saddle 28 to create a flow path between the module 14 and the bore 22. As module 18 is of a shorter length than the neighbouring modules 16, 14, channel 40 is shorter providing end supports 46*a,b* to support the module 18.

Figure 4A:
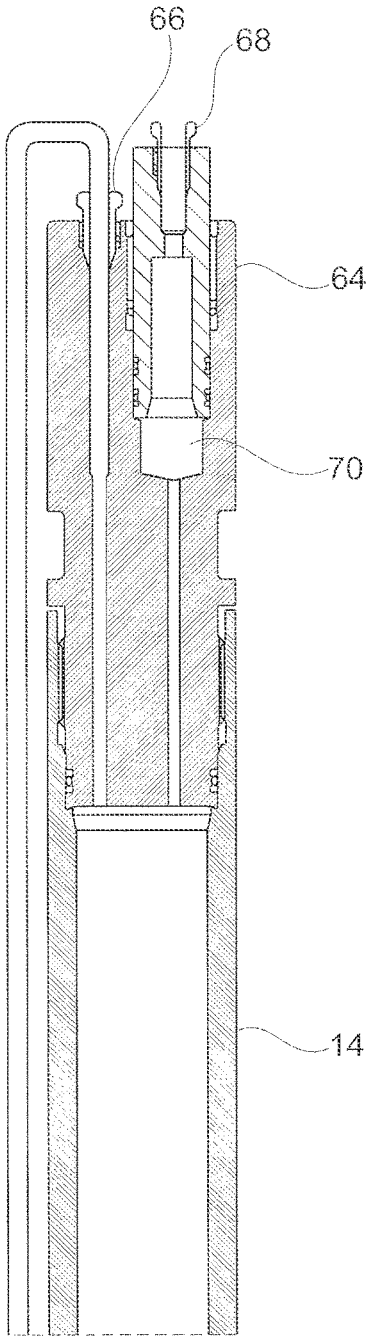
FIGS. 4(*a*)-(*c*) are sectional views of an expansion chamber module for incorporation into the body of FIG. 1.
Figure 4B:
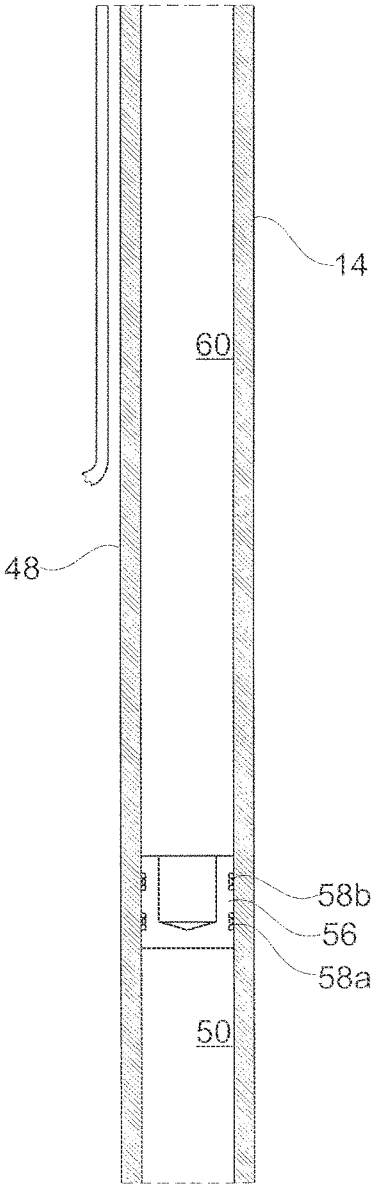
Figure 4C:
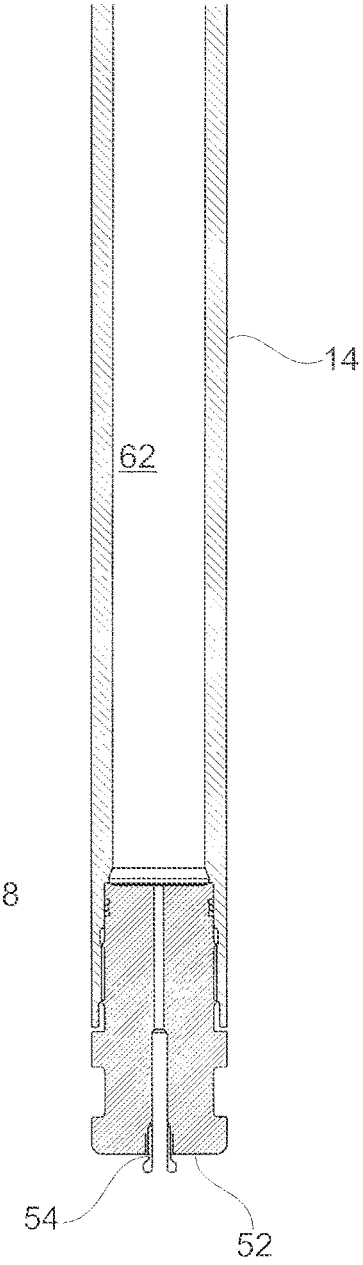

Reference is now made to FIGS. 4(*a*)-(*c*), which together show the expansion module 14. Module 14 is a substantially cylindrical body 48 having a bore 50 located through a majority of the body 48. At a lower end 52, a port 54 is provided for fluid to access the bore 50. Port 54 can connect to the port 44 on the saddle 28 to allow fluid within the bore 22 to access the bore 50. The fluid within the bore 22 is well fluid, most likely the produced fluid from the well i.e. hydrocarbons. Alternatively the well fluid may be that which is pumped from the surface down the mandrel 20.

Within the bore 50, there is located a piston 56 which includes seals 58*a,b* to separate fluids above and below the piston 56. This creates a second 60 and a first 62 chamber. The size of the chambers 60, 62 will vary dependent upon the position of the piston 56 which can move through the bore 50. Well fluid is located in the first chamber 62 and control fluid is located in the second 60 chamber. The fluids are kept apart by the seals 58*a,b*. The control fluid is typically a hydraulic oil with good lubrication properties, a low compressibility and a high temperature resistance. Such a fluid is known to those skilled in the art.

At an upper end 64 of the module 14, two ports 66, 68 are provided. The first port 66 provides a flow path for the control fluid from the second chamber 60 to the flow mechanism module 18. The second port 68 accesses a pressure transducer 70, mounted on the end 64 of the module 14. The pressure transducer 70 measures the pressure of the control fluid in the second chamber 60. An electronic connection 72 is present between the transducer 70 and the electronic module 16.

Figure 2A:
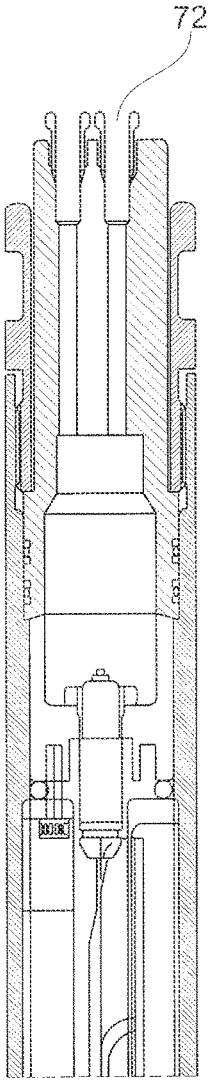
FIGS. 2(*a*)-(*c*) are sectional views of an electronic module for incorporation into the body of FIG. 1.
Figure 2B:
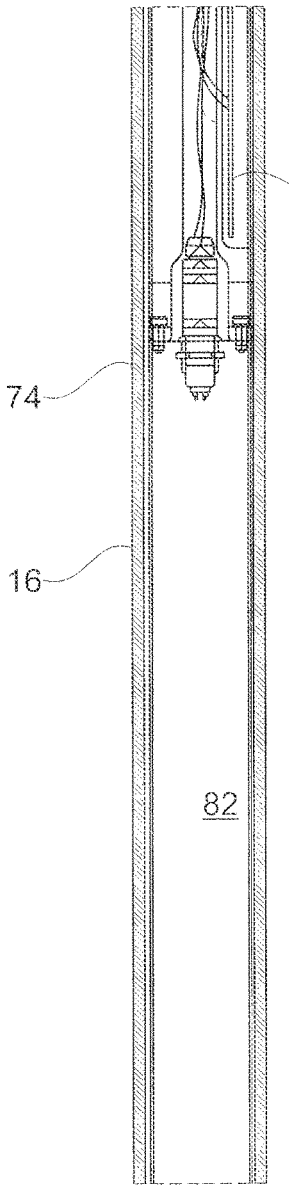
Figure 2C:
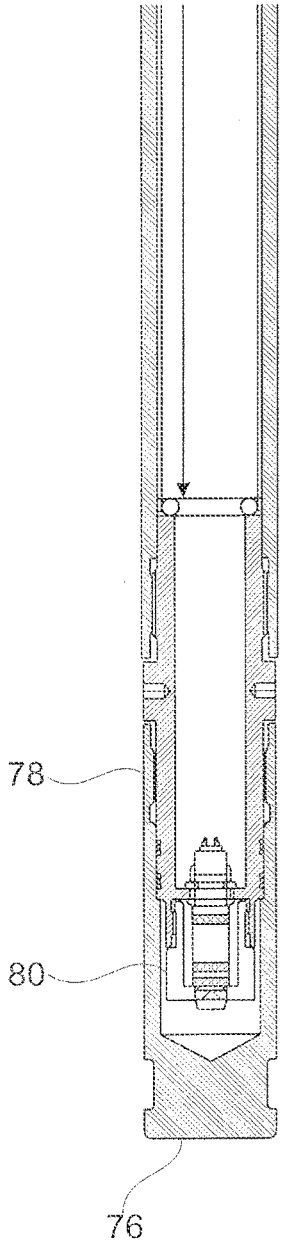

Referring now to FIGS. 2(*a*)-(*c*), which together show the electronic module 16. Module 16 has a substantially cylindrical body 74 sized to locate in the channel 38 of the saddle 28. At a lower end 76, there is a blanking end cap 78. Cap 78 covers a connection 80 which is used to link the electronics module 16 to a computer for programming the unit 10. The connection 80 also provides for the download of stored information, such as the readings from the pressure transducer, for later analysis. A large portion of the electronic module 16 is taken up with housing a battery 82. The battery 82 is used to power motors in the flow mechanism module 18 and to power the PCB 84 in the electronics module 16. The PCB 84 contains a microprocessor and the control electronics to operate the unit 10. The PCB 84 receives input signals from the pressure transducer 70. There is also an electrical connection between the PCB 84 and the flow mechanism module 18 so that the motors can be signalled to operate and power can be transferred to them for this purpose.

Figure 3A:
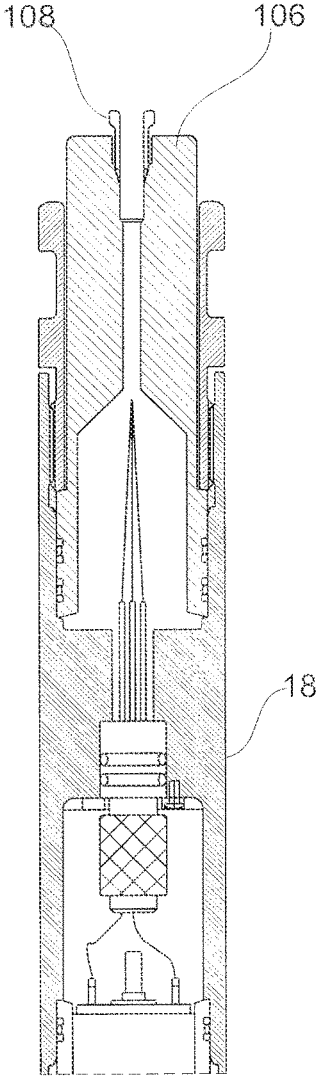
FIGS. 3(*a*)-(*c*) are sectional views of a flow mechanism module for incorporation onto the body of FIG. 1.
Figure 3B:
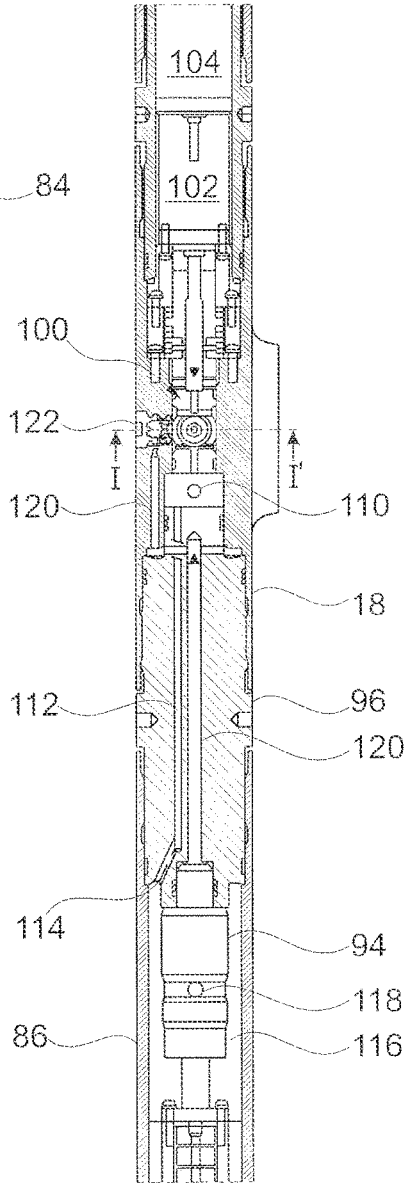
Figure 3C:
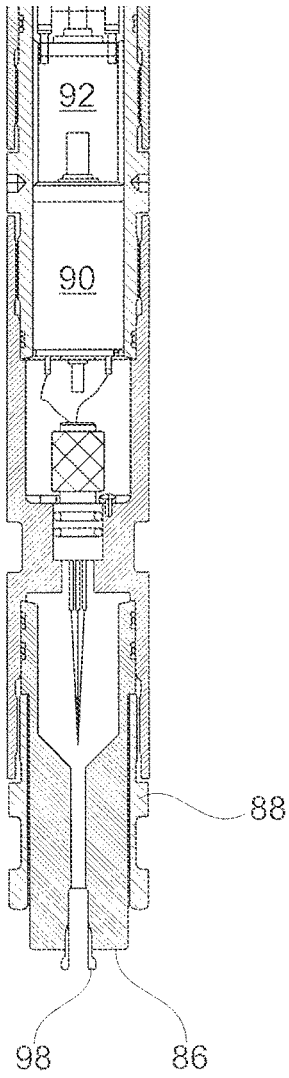

Referring now to FIGS. 3(*a*)-(*c*), which together show the flow mechanism module 18. Module 18 has a substantially cylindrical body 86 adapted for connection within the channel 40 (see FIG. 1). From a lower end 86 there is arranged an end cap 88 including an electrical connection port 98 for connection to the electronic module 16; a motor 90 to a gearbox 92 driving a micropump 94; a fluid flow chamber 96 connected to a switchable flow mechanism 100; a gear box 102 and motor 104 to drive the switchable flow mechanism 100; and an end cap 106 including an electrical connection port 108 for connection to the electronic module 16.

The switchable flow mechanism 100 is attached to the wall of the body of the downhole hydraulic control tool 10 and is covered with a cover plate 27.

Figure 5A:
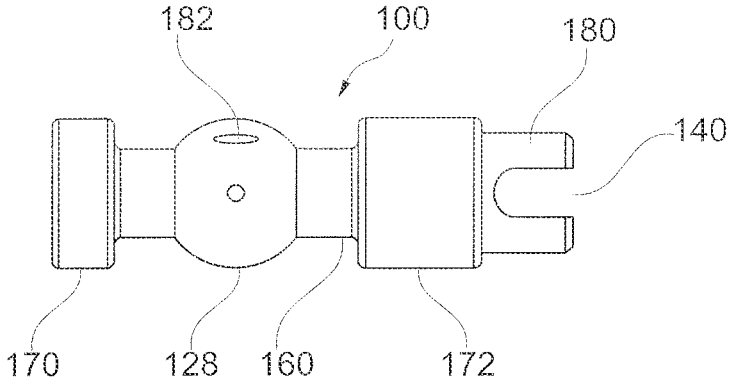
FIGS. 5(*a*)-(*c*) are a (a) plan, (b) sectional and (c) cross-sectional view through a switchable flow mechanism according to an embodiment of the present invention.
Figure 5B:
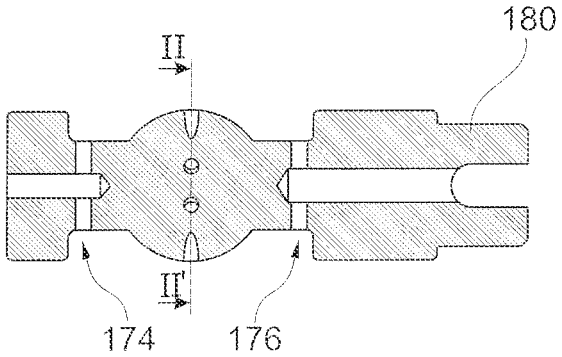
Figure 5C:
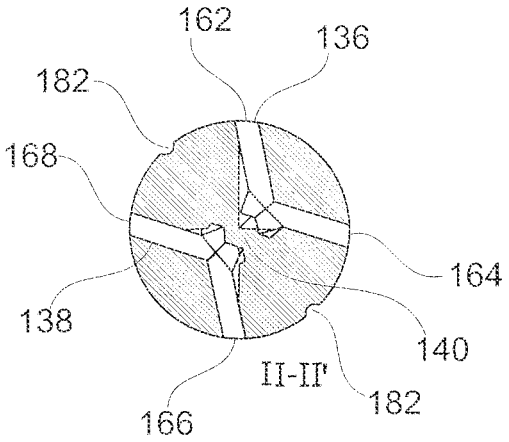

The switchable flow mechanism 100 is illustrated in FIG. 5. The mechanism 100 is a substantially cylindrical member 160 which is mounted on a central axis 140. A rounded portion, or ball 128, of the member 160 is arranged to rotate on the axis 140. Within the ball 128, there are machined two channels 136, 138 located therethrough. The channels 136, 138 are distinct in that they do not overlap or connect in any way. To achieve this, no channel is arranged through the centre 140 of the ball 128. These channels 136, 138 provide four switchable flow ports 162, 164, 166, 168 which can be used as inputs or outputs dependant upon the orientation of the ball 128.

The member 160 is supported in position by end bearing rings 170, 172. Fluid paths 174, 176 are located through the member 160 so that fluid flooding the internal volume of the body 86 can pass through these flow paths 174, 176 to assist in balancing pressure across the ball 128. Mounted to one bearing ring 172 is a spindle 180. Spindle 180 connects to the gearbox 102 of motor 104. It is thus by operating motor 104, the flow mechanism 100 is actuated and the flow paths 136, 138 can be switched.

FIGS. 8(*a*) to 8(*d*) depicts an alternative switchable flow mechanism 200. The mechanism 200 is a substantially cylindrical member 260 which is mounted on a central axis 240. A cylindrical valve 228 housed in the member 260 is arranged to rotate on the axis 240. Within the substantially cylindrical member 260, there are machined two channels 236, 238 located therethrough. The channels 236,238 are distinct in that they do not overlap or connect in any way. To achieve this, no channel is arranged to pass entirely through the centre 240 of the cylindrical valve 228. These channels 236, 238 provide two switchable flow ports 262, 264 which can be used as inputs or outputs dependant upon the orientation of the cylindrical valve 228.

Spindle 280 connects to the gearbox 102 of motor 104. It is thus by operating motor 104, the flow mechanism 200 is actuated and the flow paths 236, 238 can be switched.

In switchable flow mechanism 100, the ball 128 may be rotated 45 degrees by spindle 180 to a mid-, or neutral position. In the mid position, slots 182 of ball 128 align with fluid control lines 124, 126 (best seen in FIG. 7). In this way, a reduced fluid flow through control lines 124, 126 is permitted in order to equalise any pressure build up in the associated control lines. In this way, during run-in of the device for example, any pressure build up in one of the control lines may be equalised through the ball 128.

Figure 8A:
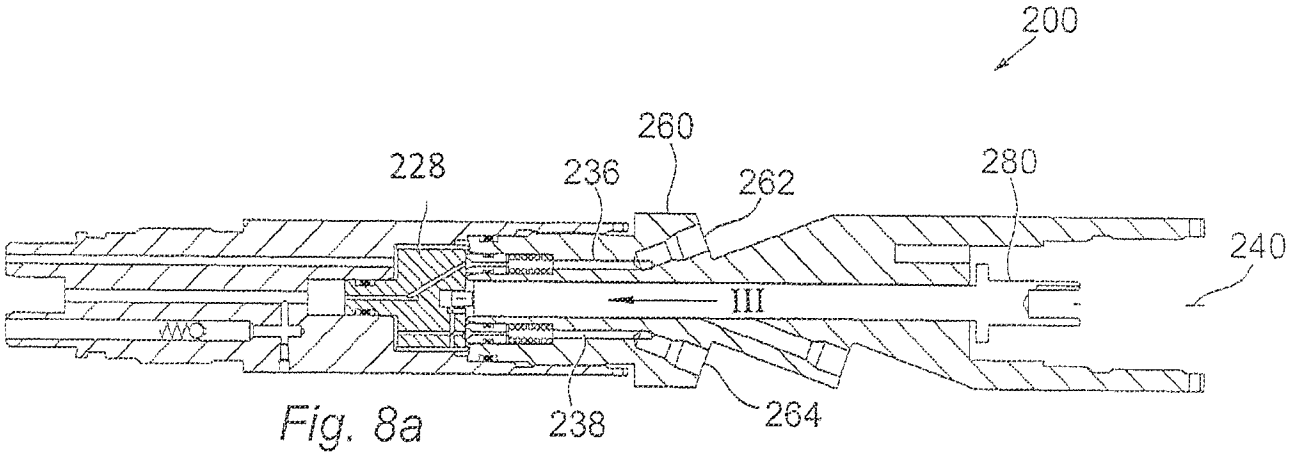
FIGS. 8(*a*) to 8(*d*) are a (a) plan, and (b), (c), (d) cross-sectional views through a switchable flow mechanism according to an alternative embodiment of the present invention.
Figure 8B:
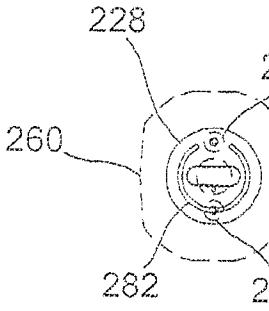
Figure 8C:
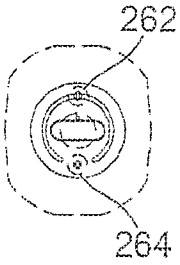
Figure 8D:
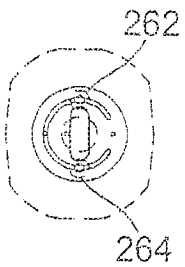

Likewise, as best seen in FIGS. 8*b, c* and *d* which are a cross section through cylindrical member 260 in the direction of the arrow "III," in switchable flow mechanism 200, the cylindrical valve 228 may be rotated 90 degrees by spindle 280 to a mid-, neutral position (FIG. 8(*d*)). In this position, groove 282 in the face of the cylindrical valve 228 allows a reduced fluid flow through ports 262, 264 in order to equalise any pressure build up in the associated control lines. In this way, during run-in of the device for example, any pressure build up in one of the control lines may be equalised through the cylindrical valve 228.

Figure 6:
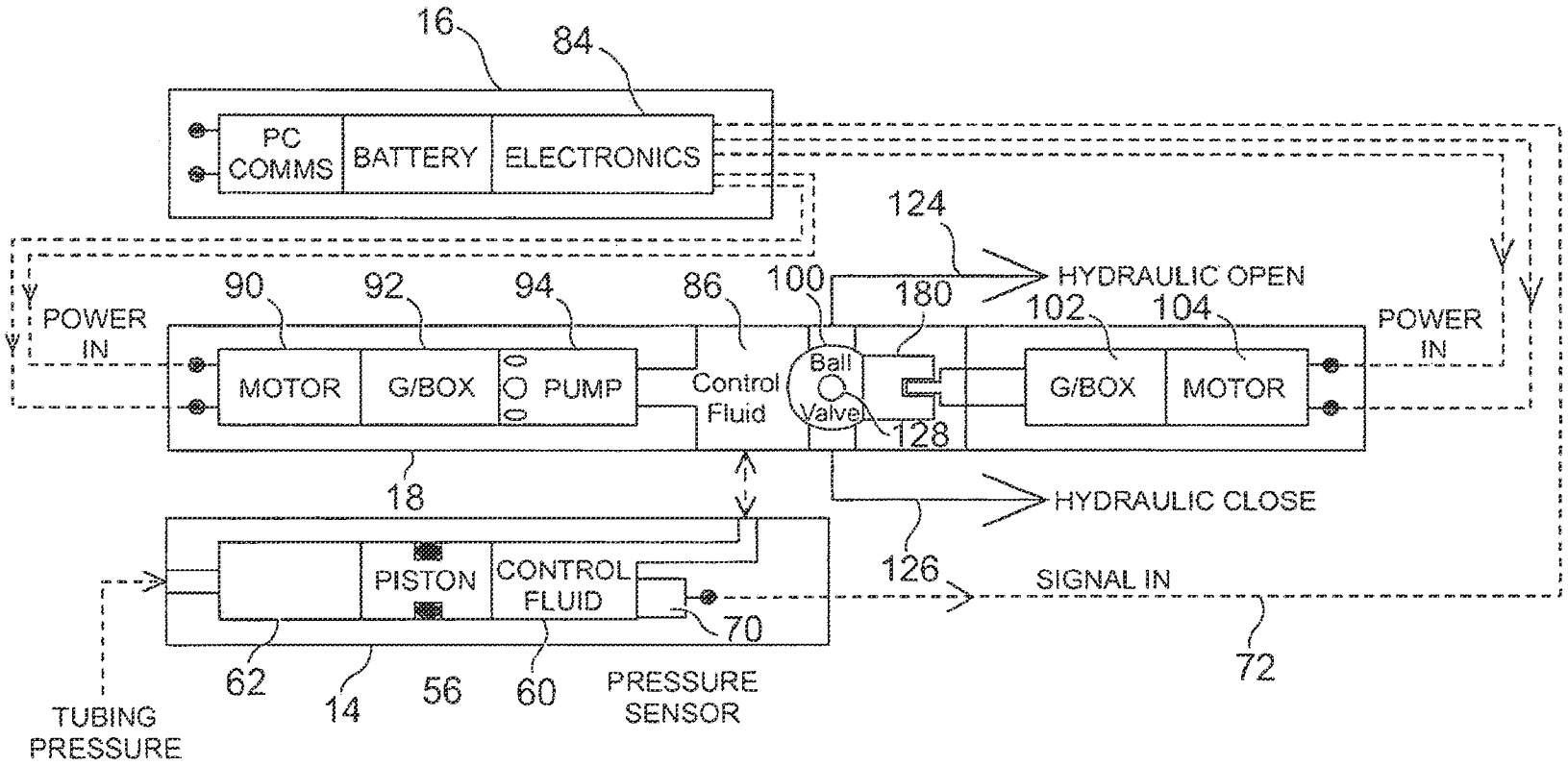
FIG. 6 is a schematic illustration of the various parts of a hydraulic control tool according to an embodiment of the present invention.

The operation of the hydraulic control tool 10 will now be described with reference to FIG. 6 and the earlier Figures also. Like parts to those of the earlier Figures have been given the same reference numeral for ease of interpretation. Each module 16, 14, 18 is assembled and a fixed volume of control fluid is placed in the second chamber 60. The modules 14, 16, 18 are located on the body 12 in pockets 36, 38, 40 and the connections between the modules made. In this regard the control fluid from the second chamber 60 enters the flow mechanism module 18 at the switchable flow mechanism 100. The fluid floods the internal volume of the body 86. More particularly, the fluid enters the port 110, travels through flow path 112 in the fluid flow chamber 96, exits at port 114 and floods the volume 116 around the pump 94. The fluid enters the pump 94 through a port 118 from whence it is pumped at high pressure down the channel 120 to enter the switchable flow mechanism 100 at a high pressure connection 122. The operation of the switchable flow mechanism 100 will be described in greater detail with reference to FIG. 7.

In use, the mandrel 20 is mounted in a string adjacent to a downhole device (not shown) and run in a well bore. Input control lines of the downhole device are connected to the fluid control lines 124, 126 which exit the flow mechanism 100 (best seen on FIG. 7). At surface, the PCB 84 has been programmed to respond to a pressure event noted at the transducer 70. This may simply be to trigger at a set pressure value. Alternatively it may be that the pressure must be held in a window for a given period of time. Various triggering events can be programmed dependent on the conditions which will be experienced in the well bore.

Well fluid enters the first chamber 62. This fluid is in the bore 22 and is either production fluid or fluid introduced at surface and pumped into the bore 22 as part of an intervention procedure. The well fluid acts against the piston 56 and compresses or allows expansion of the control fluid in the second chamber 60, by movement within the expansion chamber 50. The pressure of the control fluid is monitored by the pressure transducer 70 and the signal is relayed to the PCB 84 in the electronics module 16.

When a pressure event is realised, the motor 90 and/or the motor 104 are operated in a preprogrammed sequence. Motor 104 is operated to switch the high pressure output between the control lines 124, 126. This is achieved by the motor 104 and gearbox 102, rotating the ball 128 within the mechanism 100 by rotation of the spindle 180. This rotation is seen between FIGS. 7(*a*) and 7(*b*).

The ball 128 is in sealing contact with three ports 122, 132, 134. Port 122 is the high pressure connection from the pump 94. Arranged perpendicularly to the port 122 are the two ports 132, 134 which connect directly to the hydraulic control lines 124, 126 respectively.

Figure 7A:
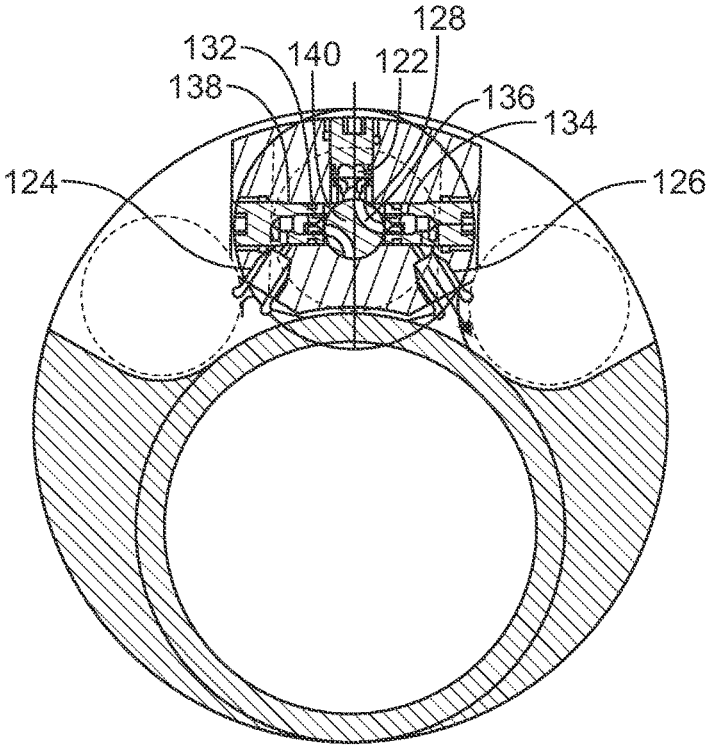
FIGS. 7(*a*) and 7(*b*) are cross-sectional views through a hydraulic control unit, illustrating switching of the flow mechanism according to an embodiment of the present invention.
Figure 7B:
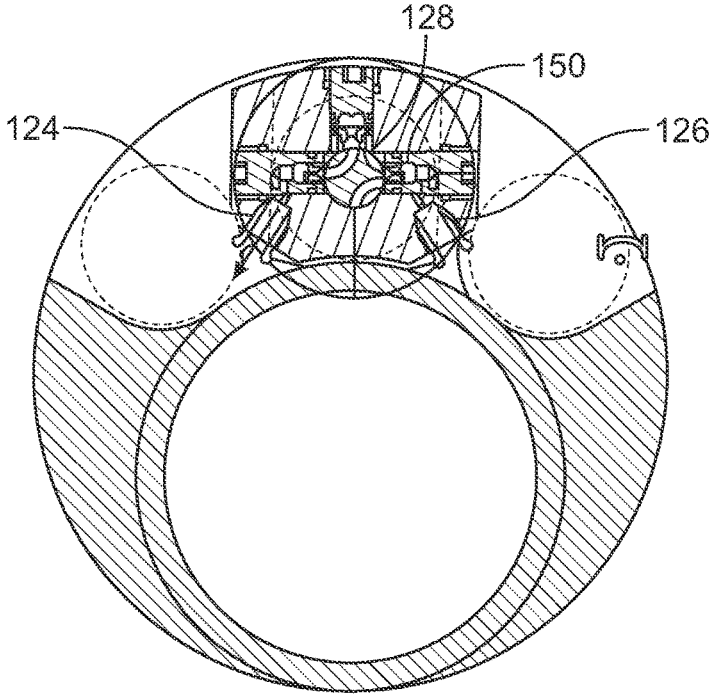

In a first configuration, shown in FIG. 7(*a*), the ball 128 is arranged such that the high pressure input 122 is aligned with the port 134. High pressure control fluid is thus pumped down control line 126 which can be used to actuate the downhole device. The second channel 138 is also arranged such that the end 168 is aligned with the port 132, while the other end 166 is open to the body 86. The fluid exiting the end 166 mixes with the fluid from the body 86. Any high pressure fluid in the control line 124 is thus released back to the low pressure in the body 86. Such a release of pressure in control line 124 can be used to actuate the downhole device also. One skilled in the art will immediately see that the actuation mechanism in the device could be arranged to be acted upon by fluid in the control lines 124, 126 arranged on opposing surfaces of a moving member such as a piston. This creates a closed loop system.

The PCB 84 can be programmed to operate the pump 94 when high pressure fluid is required by starting motor 90. The PCB 84 can also control the position of the channels 136, 138 by rotating the ball 128 via motor 104, gearbox 102 and spindle 180. As the spindle 180 is arranged perpendicularly to the ports 132, 134 and in line with the port 122, a support in the form of a bearing ring 170 is arranged on the opposite side of the ball 128 to aid rotation. Further support is provided by bearing ring 172, arranged on the opposite side of the ball 128 to further aid rotation. As can be seen between the FIGS. 7(*a*) to 7(*b*) only a 90 degree rotation of the ball 128 is required to align the ports such that the high pressure fluid is now directed through control line 124. This rotation is achieved by merely rotating the spindle by 104. A low pressure release is accordingly provided from the control line 126 to the chamber 60 via the body 86. Such a change of fluid pressure in the control lines 124, 126 can be used to actuate the downhole device to perform another function.

Advantageously, by having no bore through the centre 140 of the ball, rotation of the ball 128 can simply be achieved by on axis rotation from the gearbox 102 which simplifies the construction. Additionally switching of the mechanism 100 only requires a small i.e. 90 degree, rotation of the ball 128. Yet further, in both configurations, complete flow paths are provided and no flow path is sealed by being covered or otherwise blocked. Still further, by locating the flow mechanism between the two motors 90, 104 and flooding this area with control fluid at low pressure, we gain the benefits of lubricating rotation of the ball 128 in the housing and removing the requirement to have robust seals between the ball and housing. As can be seen, the ball 128 is held at three locations by sprung loaded rings 150 at the connectors 122, 132, 134.

Applicants co-pending application, GB 0803925.7, described a downhole hydraulic control unit mounted in a electronic completion installation valve. It will be apparent to those skilled in the art that the hydraulic control tool of the present invention can replace the unit, such that the valve could be any remotely operable tubing mounted valve as is known in the art. The downhole hydraulic control tool and the valve need then only be mounted adjacent to each other. Such an arrangement allows the downhole hydraulic control tool of the present invention to be used with downhole devices which currently connect to control lines run to the surface of the well.

A principal advantage of the present invention is that it provides a downhole hydraulic control tool having a hydraulic power source with a control line, locatable in a tubing string. In this way, there is no requirement to have control lines passing through the length of the well, the control line will only be required to span the distance between the downhole hydraulic control tool and the downhole device.

A further advantage of at least one embodiment of the present invention is that it provides a method for operating one or more downhole devices from a downhole located hydraulic control tool. Indeed multiple downhole hydraulic control tools may be located on the tubing string each operating one or more downhole devices. Each hydraulic tool can be programmed to operate on different pressure events and thus the downhole devices can be actuated in any selected order.

A yet further advantage of at least one embodiment of the present invention to provide a switchable flow mechanism with switchable flow paths for a closed loop control system. By arranging for high pressure control fluid to be placed alternately down control lines at least two functions can be performed from an enclosed volume of control fluid.

Modifications may be made to the invention herein described without departing from the scope thereof. For example, each module could be arranged coaxially to provide a single module. The switchable flow mechanism could be provided with further channels such that additional control lines could be operated from the tool.

The invention claimed is:

1. A downhole hydraulic control tool, comprising:

a substantially tubular body adapted for connection in a tubing string, the body including a throughbore arranged coaxially with a bore of the tubing string; and one or more pockets exposed on an outer wall of the body, the one or more pockets including:

at least two control lines;

a pump to drive hydraulic fluid through the control lines; and a switchable flow mechanism for switching the flow of pumped fluid between the at least two control lines.

2. The downhole hydraulic control tool according to claim 1, wherein the tool includes an electronic module, the electronic module controlling the operation of the pump and the switchable flow mechanism.

3. The downhole hydraulic control tool according to claim 2, wherein the electronic module is programmable so that the tool can be preprogrammed to behave in response to a trigger signal when downhole.

4. The downhole hydraulic control tool according to claim 2, wherein the electronics module includes a stored power supply.

5. The downhole hydraulic control tool according to claim 1, wherein the tool includes a first motor and gear assembly to operate the pump.

6. The downhole hydraulic control tool according to claim 5, wherein the tool includes a second motor and gear assembly to operate the switchable flow mechanism.

7. The downhole hydraulic control tool according to claim 5, wherein the switchable flow mechanism is located between the first motor and gear assembly and a second motor and gear assembly.

8. The downhole hydraulic control tool according to claim 1, wherein the tool includes a pressure sensor acted on by the hydraulic fluid.

9. The downhole hydraulic control tool according to claim 8, wherein the tool includes a chamber in which hydraulic fluid is located and the pressure sensor measures hydraulic fluid pressure in the chamber.

10. The downhole hydraulic control tool according to claim 9, wherein there is a piston at an end of the chamber arranged so that tubing pressure can act upon a side of the piston thereby reducing the volume of the chamber.

11. The downhole hydraulic control tool according claim 8, wherein the pressure sensor is connected to an electronics module to provide a triggering signal.

12. The downhole hydraulic control tool according to claim 1, wherein there are two control lines and the pumped fluid is switched between the control lines.

13. A method of operating one or more downhole devices from a downhole located hydraulic control tool, the method comprising the steps of:

a) locating a hydraulic control tool according to claim 1 in a tubing string;

b) locating at least one downhole device adjacent to the hydraulic control tool and connecting control lines of hydraulic control tool to control lines of the at least one downhole device;

c) running the tubing string into a well bore;

d) varying wellbore fluid pressure in the tubing to create a trigger signal for the hydraulic control tool; and e) operating the at least one downhole device by pumping hydraulic fluid through at least one of the control lines between the hydraulic control tool and the downhole device.

14. The method according to claim 13 further including the step of passing fluid through the throughbore.

15. The method according to claim 13, wherein the trigger signal for the hydraulic control tool is created by varying wellbore fluid pressure in the tubing by applying a predetermined pressure for a predetermined time.

16. The method according to claim 15, wherein the predetermined pressure is within the range 500 to 5000 psi.

17. The method according to claim 1, wherein the predetermined time period is in the range 5 to 10 mins.

18. The method according to claim 15, including the step of operating a fluid switchable flow mechanism in the hydraulic control tool to switch the pumped fluid to a second control line.

19. The method according to claim 18, wherein a second function of the downhole device is operated from the second control line.

20. The method according to claim 18, wherein a further downhole device is actuated from the second control line.

21. A method of operating a plurality of downhole devices from a plurality of downhole located hydraulic control tools, the method comprising the steps of:

a) locating a plurality of hydraulic control tools according to claim 1 in a tubing string;

b) locating each one of a plurality of downhole devices adjacent to one of the plurality of hydraulic control tools and connecting control lines of the hydraulic control tool to control lines of the adjacent downhole device;

c) running the tubing string into a well bore;

d) varying wellbore fluid pressure in the tubing to create a trigger signal for at least one of the hydraulic control tools; and e) operating at least one of the plurality of downhole devices by pumping hydraulic fluid through at least one of the control lines between the adjacent hydraulic control tool and the downhole device.

22. The method according to claim 21, further including the steps of:

f) further varying wellbore fluid pressure in the tubing to create a trigger signal for at least one further hydraulic control tool; and g) operating a further one of the plurality of downhole devices by pumping hydraulic fluid through at least one of the control lines between the further hydraulic control tool and the further downhole device.

* * * * *